US006425544B1

(12) United States Patent
Takeda

(10) Patent No.: US 6,425,544 B1
(45) Date of Patent: Jul. 30, 2002

(54) TAPING DEVICE AND TAPING METHOD

(75) Inventor: Kyoji Takeda, Tokyo (JP)

(73) Assignee: Tanaka Seiki Co., Ltd., Tokyo (JP)

( * ) Notice: Subject to any disclaimer, the term of this patent is extended or adjusted under 35 U.S.C. 154(b) by 119 days.

(21) Appl. No.: 09/684,007

(22) Filed: Oct. 6, 2000

(30) Foreign Application Priority Data

Dec. 28, 1999 (JP) ..... 11-373097
Jul. 21, 2000 (JP) ..... 2000-220411

(51) Int. Cl.[7] ..... B65H 81/06; B21C 47/02
(52) U.S. Cl. ..... 242/443; 242/444.2; 242/444.5
(58) Field of Search ..... 242/437.3, 443, 242/444.2, 444.5, 445.1

(56) References Cited

U.S. PATENT DOCUMENTS 1,036,937 A * 8/1912 Underhill ..... 242/444.2
1,870,713 A * 8/1932 Jong ..... 242/444.5
1,888,275 A * 11/1932 Larsen ..... 242/444.5
5,012,565 A * 5/1991 Gillet ..... 242/444.2
5,016,832 A * 5/1991 Curtis, Jr. et al. ..... 242/443
5,284,541 A * 2/1994 Kambara ..... 156/192
5,544,827 A * 8/1996 Yano ..... 242/445.1
5,614,042 A * 3/1997 Nishide et al. ..... 156/53
5,664,736 A * 9/1997 Murakoshi et al. ..... 242/444.2
5,806,781 A * 9/1998 Ujita et al. ..... 242/444.5

FOREIGN PATENT DOCUMENTS

DE 880179 * 6/1953 ..... 242/444.5
FR 1.235.215 9/1959
GB 2.102.210 A 1/1983
JP 401014910 * 1/1989 ..... 242/443

OTHER PUBLICATIONS

Tucker, John G., Automatic Taping of Inductance Coils, Western Electric Eng., vol. 23., No. 2.*
European Search Report for Application No. EP 00 12 1669.

* cited by examiner

*Primary Examiner*—Emmanuel M. Marcelo
(74) *Attorney, Agent, or Firm*—Rosenthal & Osha L.L.P.

(57) ABSTRACT

A taping technology capable of restraining an ill-wound state of a tape is disclosed. Chucking members of a leading chuck and chucking members of a trailing chuck have widths narrow enough to enter between flange members of a bobbin, and are therefore capable of grasping leading and trailing ends of the tape till the chucking members get close to a wire member wound on a cylindrical member, whereby disordered states at the leading and trailing ends of the tape can be restrained as much as possible and an ill-wound state of the tape can be therefore restrained.

10 Claims, 15 Drawing Sheets

TAPING DEVICE AND TAPING METHOD

BACKGROUND OF THE INVENTION

1. Field of the Invention

The present invention relates to a technology of winding a tape on a bobbin.

2. Related Background Art

In the case of manufacturing a coil for a transformer, a wire member is wound in tiers on a periphery of a resinous bobbin, however, an insulating tape is wound between these tiers. To be more specific, a first tiered wire member is wound on the periphery of the bobbin, and thereafter the insulating tape is wound on its periphery. After this winding process, a second-tiered wire member is wound, and the insulating tape is further wound on its periphery. These processes are repeated, thereby forming a multi-tired coil.

By the way, according to a conventional taping technology, after the first-tiered wire member has been wound on the periphery of the bobbin, a vicinity of a leading end of the insulating tape of which one-sided surface is an adhesive surface is grasped by a chuck, and the leading end side is adhered to the wire member wound thereon and more closely adhered to the periphery of the wiremember by rotating the bobbin while pressing it with a press-fitting device such as a roller etc.

A certain type of bobbin, however, has a pair of flange members largely extending in radial directions from both ends of a bottom surface member wound with the wire member. In this type of bobbin, the tape is cut off outwardly of the flange members, and hence the trailing end of the tape remains long in a freely movable state. If wound in this state, there might be a possibility of causing a slackness and an ill-adhered state of the tape even when adhered while being pressed by the press-fitting device such as the roller etc.

In a further different type of bobbin, an interval between the flange members, i.e., a winding width of the wire member is 2 mm or smaller, and a width of the tape wound on this type of bobbin is also approximately 2 mm or smaller. Therefore, when the tape is wound on the bobbin with its trailing end remaining as a free end, there might occur a winding defect such as sticking to an inner surface of the flange member even if provided with the press-fitting device.

In addition, according to the conventional taping technology, in that type of bobbin having the small width, a problem arises, wherein the tape is biased toward the one flange member. It is therefore required that the tape be wound at a high accuracy in a way of aligning the central line of the bobbin with the central line of the tape.

SUMMARY OF THE INVENTION

It is a primary object of the present invention, which was devised to obviate those problems inherent in the prior art, to provide a taping technology capable of restraining a winding defect of the tape.

To accomplish the above object, according to one aspect of the invention, a taping device, of a first invention, for winding a tape on a bottom surface member or on a winding wound on the bottom surface member of a bobbin including the bottom surface member wound with a wire member and a pair of flange members extending in radial directions from the bottom surface member, comprises a grasping device provided with grasping entering between the flange members of the bobbin while grasping a trailing end or its vicinity of the tape wound on the bobbin.

According to another aspect of the invention, of a second invention, for winding a tape on a bottom surface member of a bobbin including the bottom surface member wound with a wire member and a pair of flange members extending in radial directions from the bottom surface member, comprises a chuck for gasping the tape, wherein grasping members of the chuck have such a configuration that at least part of the surface, closer to the bottom surface member of the bobbin, of the tape becomes convex when grasping the tape.

According still another aspect of the invention, a taping method, of a third invention, of winding a tape on a bottom surface member of a bobbin including the bottom surface member wound with a wire member and a pair of flange members extending in radial directions from the bottom surface member, comprises a step of pulling the tape out of a supply member for the tape in such a way that chucking members of a leading chuck grasp a leading end or its vicinity of the tape, a step of making the chucking members of the leading chuck enter between the flange members of the bobbin, adhering the leading end or its vicinity of the tape to the bottom surface member, and thereafter releasing the tape from the chucking members of the leading chuck, a step of cutting off the tape with chucking members of a trailing chuck while grasping the tape in a position spaced at a predetermined distance away from the leading end thereof and on the side closer to the supply member than the grasping position, a step of making the trailing chuck proximal to the bobbin together with the tape of which the trailing end or the vicinity is grasped by the chucking members in synchronization with rotations of the bobbin, and a step of releasing the tape after adhering the tape to the bottom surface member by making the chucking members of the trailing chuck enter between the flange members of the bobbin.

According to a further aspect of the invention, a taping method, of a fourth invention, of winding a tape on a bottom surface member of a bobbin including the bottom surface member wound with a wire member and a pair of flange members extending in radial directions from the bottom surface member, comprises a step of pulling the tape out of a supply member for the tape in such a way that chucking members of a leading chuck grasp a leading end or its vicinity of the tape, a step of making the chucking members of the leading chuck enter between the flange members of the bobbin, adhering the leading end or its vicinity of the tape to the bottom surface member, and thereafter releasing the tape from the chucking members of the leading chuck, a step of making the bobbin and the supply member for the tape approach each other with the tape wound on the bottom surface member of the bobbin by rotating the bobbin with a predetermined number of rotations, a step of making at least a part of the supply member for the tape enter between the pair of flange members of the bobbin by pressing the tape against the supply member for the tape, and a step of cutting off the tape with a cutter edge having a width narrower than a space between the flange members of the bobbin between the supply member for the tape and the bottom surface member of the bobbin.

The taping device according to the first invention winds the tape on the bottom surface member or on the winding wound on the bottom surface member of the bobbin including the bottom surface member wound with the wire member and the pair of flange members extending in the radial directions from the bottom surface member. This taping device includes the trailing chuck provided with the chucking members entering between the flange members of the bobbin while grasping the trailing end or its vicinity of the tape wound on the bobbin. The chucking members are therefore capable of approaching the bottom surface member (including the state of being wound with the wire member) while grasping the trailing end or its vicinity of the tape, whereby the disordered state at the trailing end of the tape can be restrained to the greatest possible degree and the ill-wound state of the tape can be therefore restrained.

The grasping device may be a trailing chuck.

Further, the grasping member of the trailing chuck may have a width equal to or smaller than a width of the tape enough to easily enter between the flange members.

The trailing chuck may have a cutter edge for cutting off the tape, whereby the tape can be grasped and cut off simultaneously.

The supply member for the tape may be provided with the grasping means.

The taping device according to the second invention has the bobbin including the bottom surface member wound with the wire member and the pair of flange members extending in the radial directions from this bottom surface member, and the tape is wound on the bottom surface member. In this taping device, the chucking members of the chuck for grasping the tape has such a configuration that at least a part of the surface, closer to the bottom surface member of the bobbin, of the tape becomes convex when grasping the tape. Hence, the convex area is matched with a corresponding portion of the bottom surface member (including the state of being wound with the wire member), whereby the winding can be performed with a high accuracy by aligning the central position of the bottom surface member with the central line of the tape.

The taping method, according to the third invention, of winding the tape on the bottom surface member of the bobbin including the bottom surface member wound with the wire member and the pair of flange members extending in the radial directions from this bottom surface member, includes the step of pulling the tape out of the supply member for the tape in such a way that the chucking members of the leading chuck grasp the leading end or its vicinity of the tape, the step of making the chucking members of the leading chuck enter between the flange members of the bobbin, adhering the leading end or its vicinity of the tape to the bottom surface member, and thereafter releasing the tape from the chucking members of the leading chuck, the step of cutting off the tape with the chucking members of the trailing chuck while grasping the tape in a position spaced at a predetermined distance away from the leading end thereof as well as being closer to the supply member than the grasping position, the step of making the trailing chuck proximal to the bobbin together with the tape of which the trailing end or the vicinity is grasped by the chucking members in synchronization with the rotations of the bobbin, and the step of releasing the tape after adhering the tape to the bottom surface member by making the chucking members of the trailing chuck enter between the flange members of the bobbin. The chucking members are therefore capable of approaching the bottom surface member (including the state of being wound with the wire member) while grasping the leading and trailing ends or their vicinities of the tape, whereby the disordered states at the leading and trailing ends of the tape can be restrained to the greatest possible degree and the ill-wound state of the tape can be therefore restrained.

When the trailing chuck moves towards the bobbin while giving a predetermined tension to the grasped tape, thereby making it feasible to perform more proper winding by restraining the tape from slackening.

The taping method, according to the fourth invention, of winding the tape on the bottom surface member of the bobbin including the bottom surface member wound with the wire member and the pair of flange members extending in the radial directions from this bottom surface member, includes the step of pulling the tape out of the supply member for the tape in such a way that the chucking members of the leading chuck grasp the leading end or its vicinity of the tape, the step of making the chucking members enter between the flange members of the bobbin, adhering the leading end or its vicinity of the tape to the bottom surface member, and thereafter releasing the tape from the chucking members of the leading chuck, the step of making the bobbin and the supply member for the tape approach each other with the tape wound on the bottom surface member of the bobbin by rotating the bobbin with a predetermined number of rotations, the step of making at least a part of the supply member for the tape enter between the pair of flange members of the bobbin by pressing the tape against the supply member for the tape, and the step of cutting off the tape with the cutter edge having a width narrower than a space between the flange members of the bobbin between the supply member for the tape and the bottom surface member of the bobbin. Hence, in addition to the effects of the inventions described above, when cutting off the tape, there is a small area in the vicinity of the trailing end of the tape that is separated from the bottom surface member (including the state of being wound with the wire member), whereby the disordered states at the leading of the tape as well as at trailing end can be restrained as much as possible and the ill-wound state of the tape can be therefore restrained.

The taping method may further comprise a step of pulling the tape out of the supply member for the tape by rotating the bobbin. Even if a pulling quantity of the tape by the leading chuck is insufficient, the tape can be pulled out till a proper winding quantity is obtained by rotating the bobbin.

DETAILED DESCRIPTION OF THE PREFERRED EMBODIMENTS

Embodiments of the present invention will hereinafter be described with reference to the accompanying drawings.

FIGS. 1 to 6 are side views each showing a taping device 10 in a first embodiment of the present invention.

Figure 1:
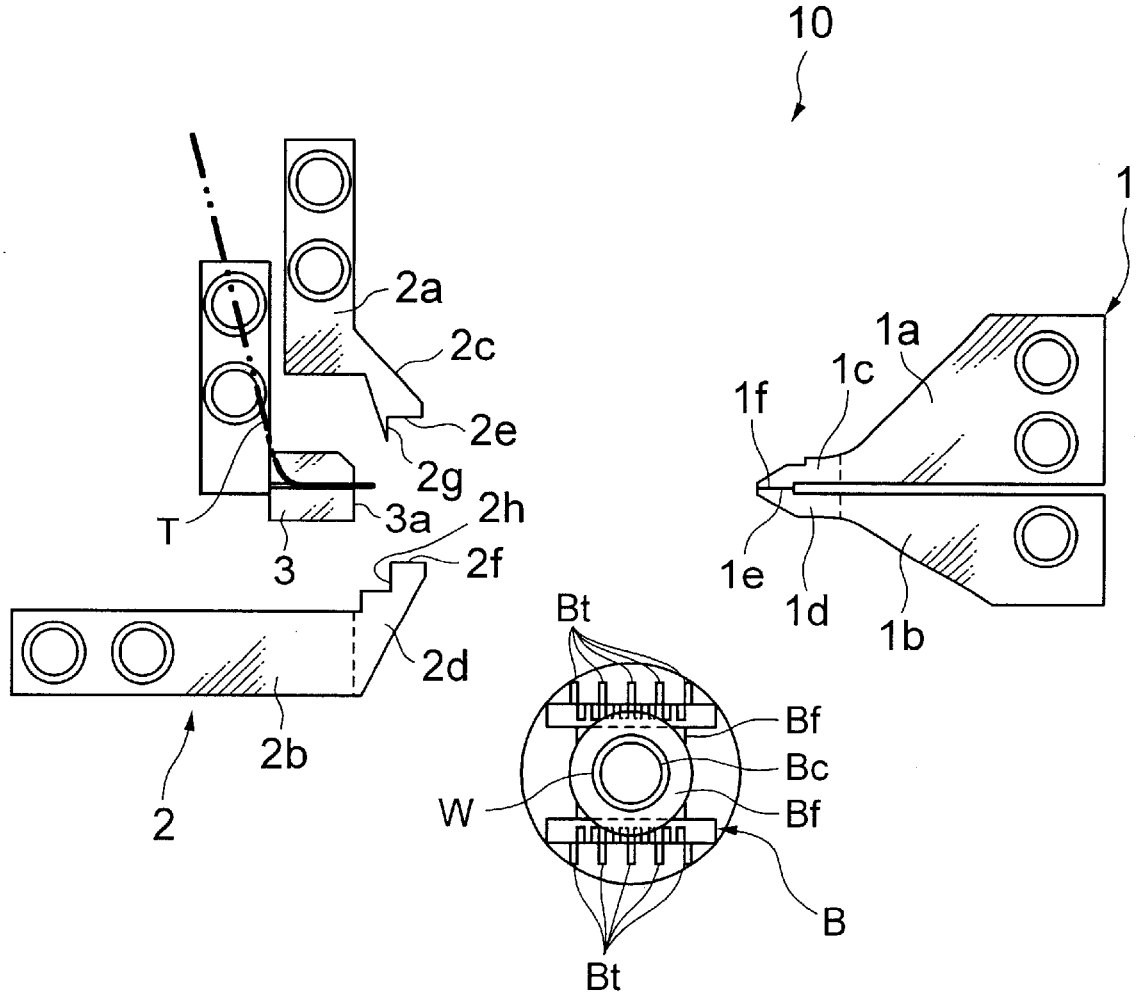
FIG. 1 is a side view showing a taping device in a first embodiment of the present invention.

Referring to FIG. 1, the taping device 10 includes a leading chuck 1 constructed of a pair of arms 1*a*, 1*b*, a trailing chuck (grasping means) 2 constructed of a pair of arms 2*a*, 2*b*, and a tape supply unit 3.

A bobbin B wound with a wire member in five tiers (the number of tiers is not necessarily limited to five), has a cylindrical member Bc serving as a bottom surface member having a width of, e.g., 2 mm or smaller, and flange members Bf formed at both ends thereof and extending in radial directions. Note that terminal pins Bt to which ends of the wire members (not shown) wound thereon are secured, are formed along an outer periphery of the one-sided flange member Bf. The bobbin B is rotatable by an unillustrated drive unit.

The leading chuck 1 is capable of moving the pair of arms 1*a*, 1*b* apart from or close to each other, and is movable in three-dimensional directions including at least two-dimensional directions in FIG. 1. A drive unit for the leading chuck 1 is not shown herein.

The arms 1*a*, 1*b* of the leading chuck 1 are, as shown on the left side in FIG. 1, provided with chucking members 1*c*, 1*d* having a width narrower than the cylindrical member Bc of the bobbin B. Chucking surfaces 1*e*, 1*f* facing to each other are provided at left ends of the chucking members 1*c*, 1*d*.

The trailing chuck 2 is also capable of moving the pair of arms 2*a*, 2*b* apart from or close to each other, and is movable in the three-dimensional directions including at least the two-dimensional directions in FIG. 1. A drive unit for the leading chuck 1 is not shown either.

The arms 2*a*, 2*b* of the trailing chuck 2 are, as shown on the right side in FIG. 1, provided with chucking members 2*c*, 2*d* having a width narrower than the cylindrical member Bc of the bobbin B. Chucking surfaces 2*e*, 2*f* facing to each other are provided at right ends of the chucking members thereof. Note that the upper arm 2*a* is formed with a cutter edge 2*g* extending downwards on the side of the tape supply unit in proximity to the chucking surface 2*e*, and the lower arm 2*b* is formed with a cutter receiving surface 2*h* facing to the cutter edge 2*g*.

The supply unit 3 is provided with a tape brake mechanism for, e.g., mechanically locking a movement of the tape. The tape brake mechanism incorporates a function of preventing a tape T from being pulled out unintentionally by giving a friction force to the tape T as when cutting the tape T, or pulling out the tape T by chucking it with the leading chuck 1 and adhering the tape T to the bobbin B. A construction of this mechanism is well known, and hence its detailed explanation is omitted.

Next, an operation of this embodiment will be described. To start with, it shall be assumed that a first-tiered winding W has already been wound on the bobbin B, and the arms 2*a*, 2*b* of the trailing chuck 2 remain opened. In the state shown in FIG. 1, the leading chuck 1 is moved toward the supply unit 3 by the unillustrated drive unit in order to grasp a leading end of the tape T extruded from a supply port 3*a* of the supply unit 3. Note that a width of the tape T is set slightly larger than the width of the cylindrical member Bc of the bobbin B, and the under surface of the tape T is formed as an adhesive surface.

Figure 2:
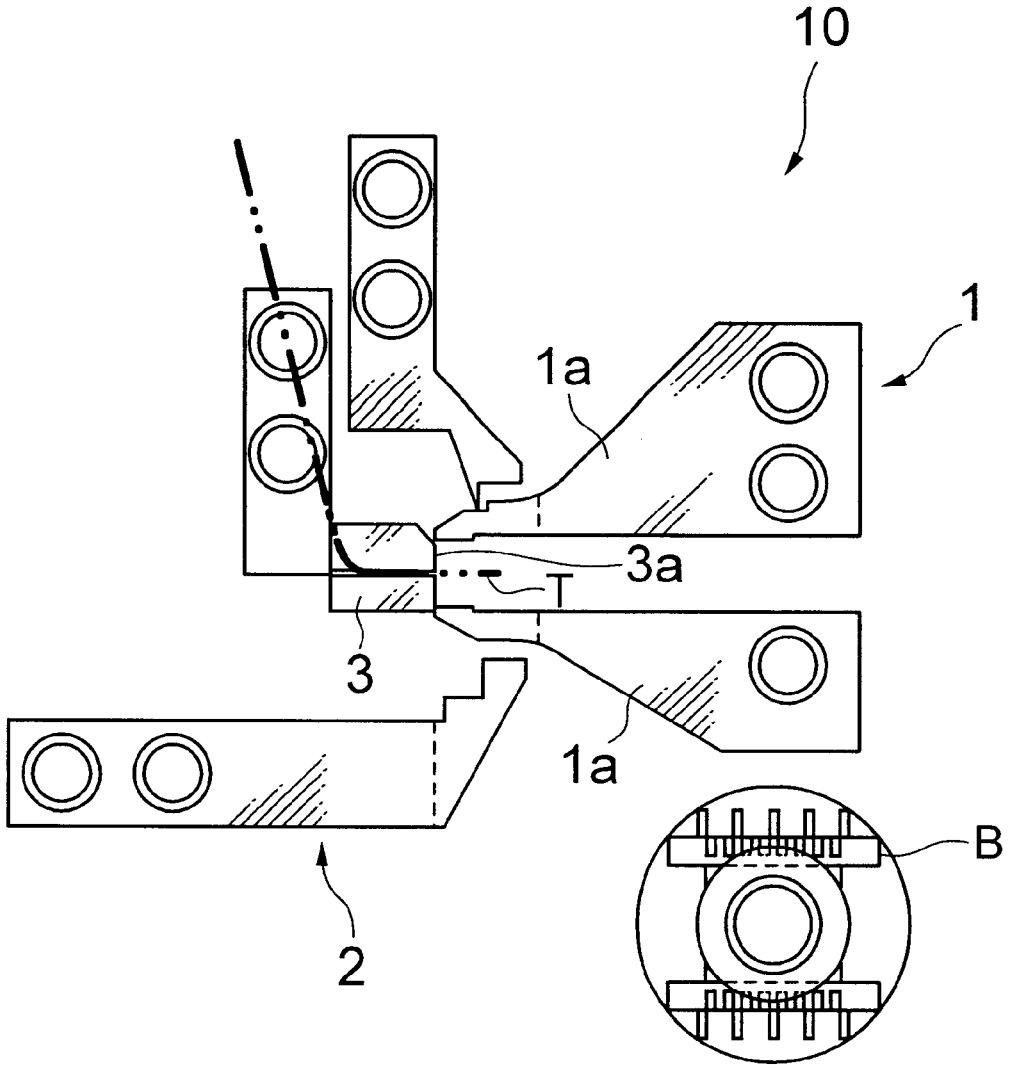
FIG. 2 is a side view showing the taping device in the first embodiment of the present invention.
Figure 3:
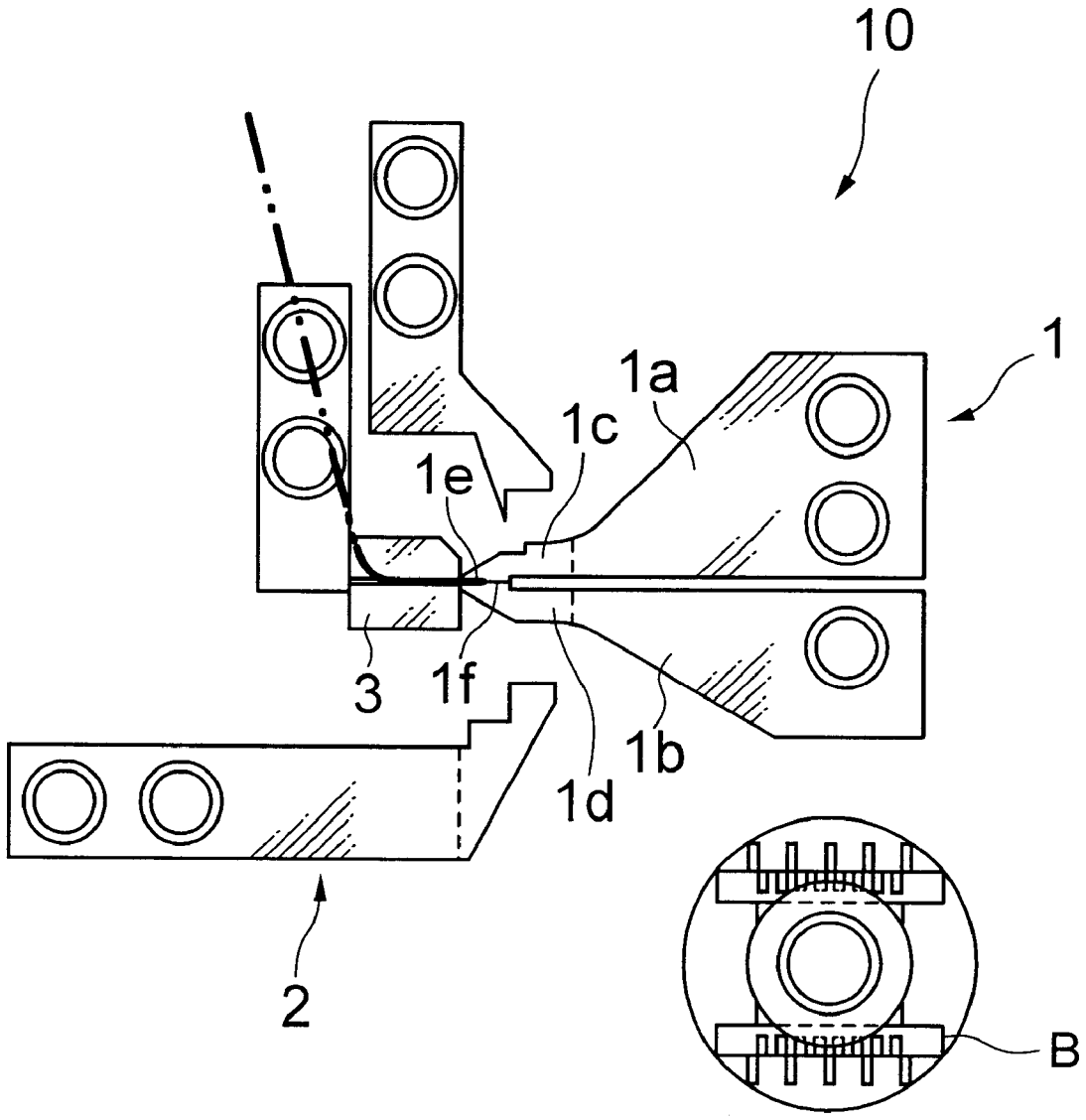
FIG. 3 is a side view showing the taping device in the first embodiment of the present invention.

Subsequently, as shown in FIG. 2, the arms 1*a*, 1*b* of the leading chuck 1 are stopped as the arms 1*a*, 1*b* are spaced away from each other just when arriving at such a position that the leading end of the tape T extruding from the supply port 3*a* of the supply unit 3 enters an aperture between the arms 1*a*, 1*b* enough to be bitten as seen in the vertical direction. Then, as illustrated in FIG. 3, the arms 1*a*, 1*b* are made close to each other, and the leading end of the tape T is bitten by the chucking surfaces 1*e*, 1*f* of the chucking members 1*c*, 1*d*.

Figure 4:
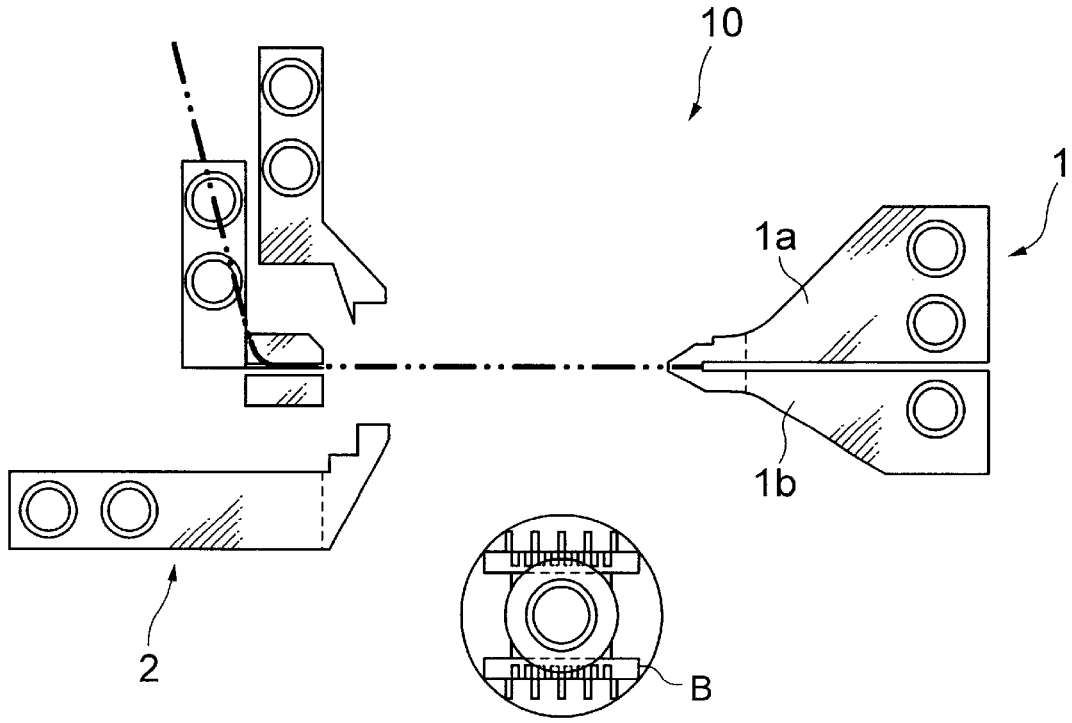
FIG. 4 is a side view showing the taping device in the first embodiment of the present invention.
Figure 5:
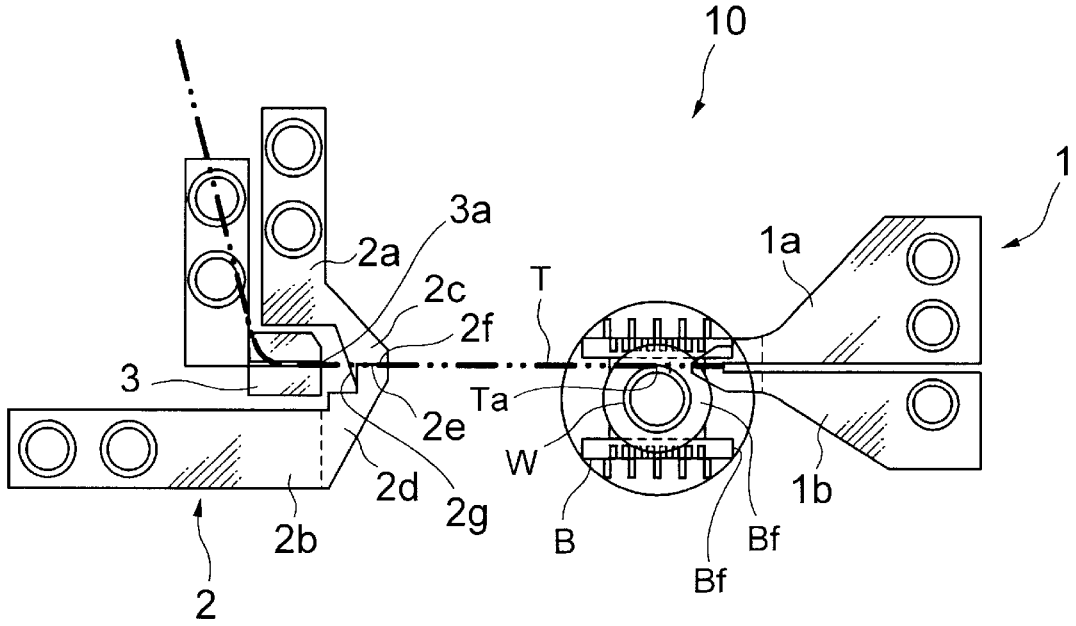
FIG. 5 is a side view showing the taping device in the first embodiment of the present invention.
Figure 6:
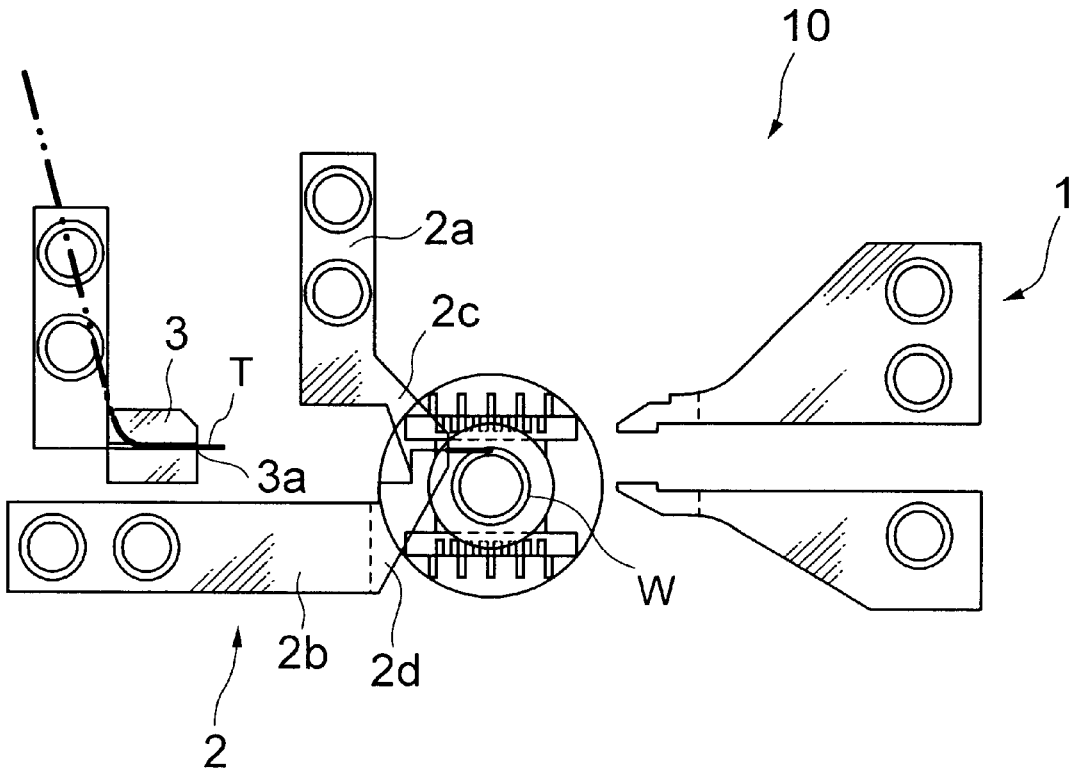
FIG. 6 is a side view showing the taping device in the first embodiment of the present invention.

Further, as shown in FIG. 4, the leading chuck 1 is moved rightward upwardly of the bobbin B in order to pull out the tape T by a length required to be wound in such a way that the leading end of the tape T is kept bitten. Thereafter, as shown in FIG. 5, a finger member is moved downward, however, the chucking members 1*c*, 1*d* of the leading chuck 1 enter between the flange members Bf of the bobbin B at that time. In this state, the tape adhesive surface in the vicinity of the leading end of the tape T is adhered to a periphery of the first-tiered winding, and the arms 1*a*, 1*b* are set apart from each other in this as-adhered state, with the result that a leading end vicinity Ta of the tape T is adhered to the surface of the wire member W wound on the bobbin B. Accordingly, though there is a small peeled-off area of the tape T on its leading end side, the leading chuck 1 may be driven so that the arm 1*a* or 1*b* touches the peeled-off area of the tape T down along the periphery of the winding.

Thereafter, when the arms 2*a*, 2*b* of the trailing chuck 2 are made close to each other enough to bite the tale T, the cutter edge 2*g* cuts off the bitten area of the tape T on the side of the supply unit 3, with the result that the trailing end of the tape T is grasped. Note that a width of the cutter edge 2*g* is the same as a width of the chucking member 2*c*, i.e., smaller than a width of the tape T, and hence, though the tape T is not completely cut off by the operation of the cutter edge 2*g*, if the trailing chuck 2 chucking the tape T is moved away from the supply unit 3, the tape T can be easily cut along a cut line formed by the cutter edge 2*a*. It is to be noted that the tape T in this state is kept so that the leading end thereof is pulled out of the supply port 3*a* of the supply unit 3 (see FIG. 6).

When the bobbin B is rotated from this state and the trailing chuck 2 is made proximal to the bobbin B synchronizing with this rotation, in a state of a proper tension being given, it follows that the tape T is wound on the periphery of the winding round on the bobbin B. A contrivance is that the chucking members 2*c*, 2*d* of the trailing chuck 2 eventually enter between the flange members Bf of the bobbin B. If the trailing chuck 2 is made sufficiently close to the winding W, and if the arms 2*a*, 2*b* are moved apart from each other keeping this state, a large proportion of the trailing end vicinity of the tape T is adhered to the bobbin B. Accordingly, there is a small peeled-off area of the trailing end of the tape T, however, the trailing chuck 2 may be driven so that the lower arm 2*b* (or the upper arm 2*b*) touches the peeled-off area of the tape T down along the periphery of the winding.

Thereafter, the bobbin B and the trailing chuck 2 are moved back to the previous positions (see FIG. 1), thus finishing the tape winding process. Then, the winding of a next tier may be carried out.

As discussed above, according to this embodiment, the chucking members 1*c*, 1*d* of the leading chuck 1 and the chucking members 2*c*, 2*d* of the trailing chuck 2, are narrow enough to enter between the flange members Bf of the bobbin B. Accordingly, those chucking members can approach the wire member W wound on the cylindrical member Bc while grasping the leading and trailing ends of the tape T, whereby disordered states at the leading and trailing ends of the tape can be restrained as much as possible and an ill-wound state of the tape can be therefore restrained.

Figure 7:
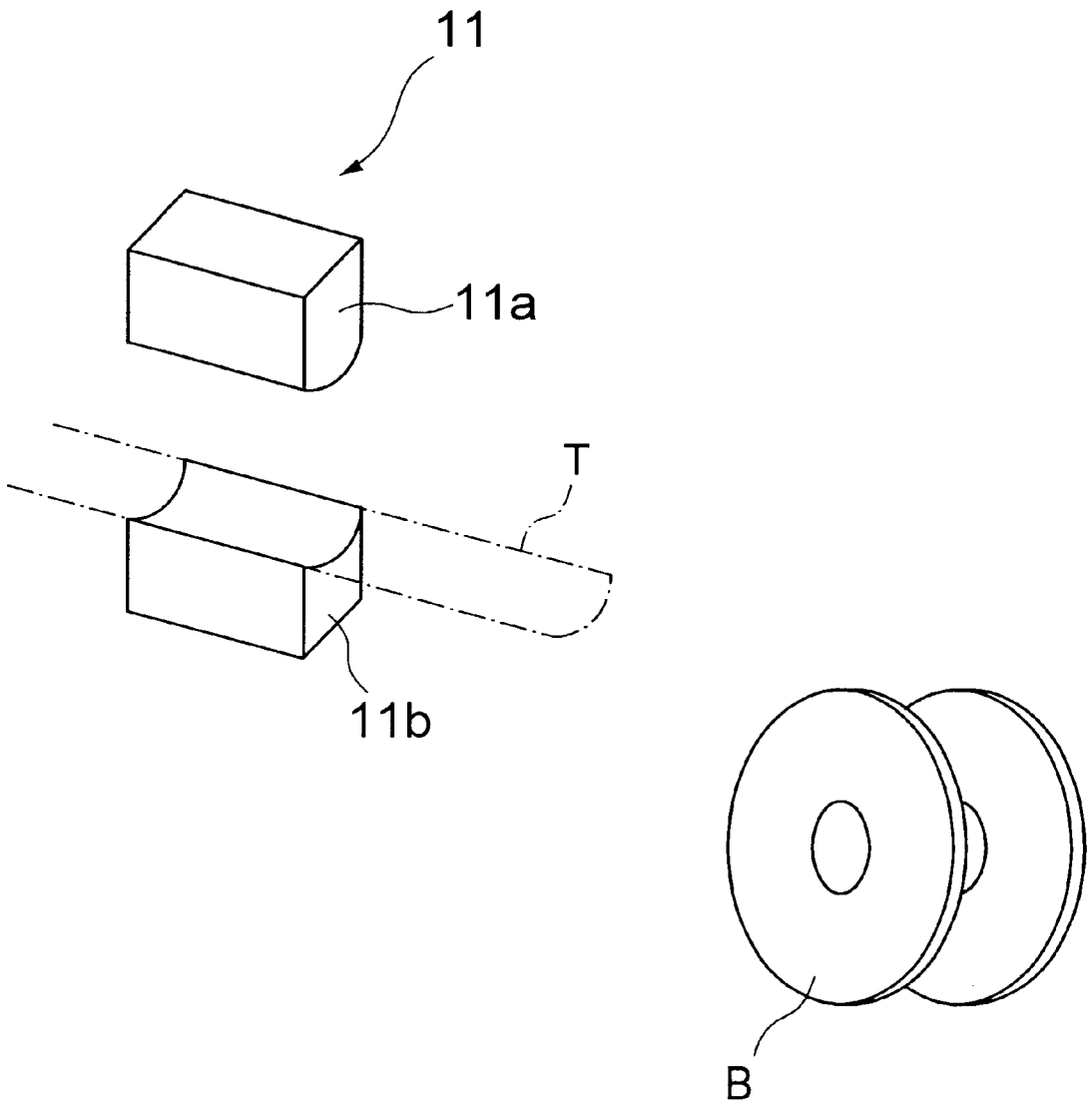
FIG. 7 is a side view showing a chuck in a second embodiment of the present invention.

FIG. 7 is a perspective view showing the chuck in a second embodiment. Any one of the leading chuck and the trailing chuck shown in FIGS. 1 to 6 or both of them may be usable as this type of chuck.

As shown in FIG. 7, an upper chucking member 11*a* of a chuck 11 has a lower surface taking a convex configuration (circular arc as seen from the front). On the other hand, corresponding to this configuration, the lower chucking member 11*b* of the chuck 11 has an upper surface assuming a concave configuration. Accordingly, when chucking the tape T with the upper chucking member 11*a* and the lower chucking member 11*b*, the tape T is deformed downwards in the convex shape.

Figure 8:
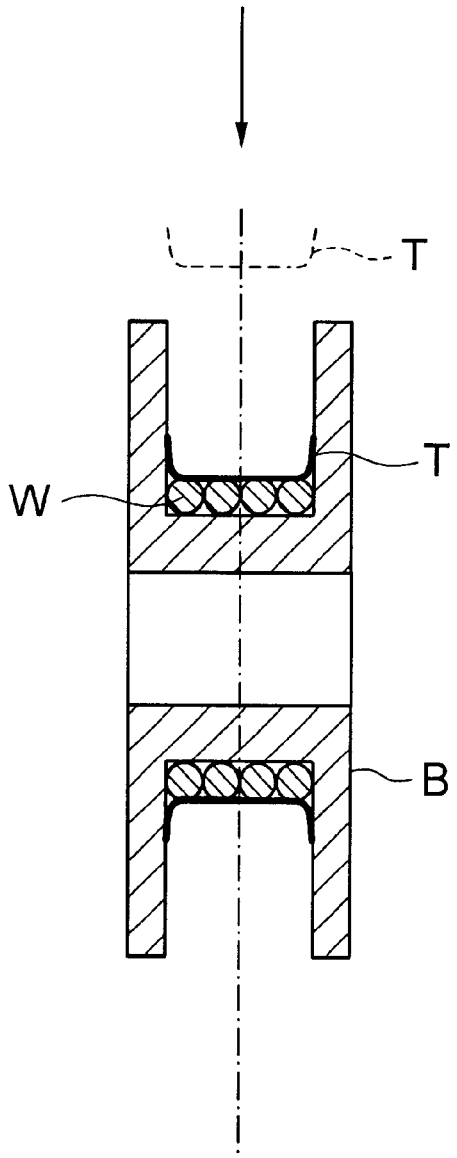
FIG. 8 is a view showing a state of how a tape is wound on a periphery of a wire member wound on a bobbin.

FIG. 8 is a view showing a state when the tape T is wound on the periphery of the wire member W wound on the bobbin B. As illustrated in FIG. 8, when the center of the bobbin B is aligned with the center of the tape T, the winding that is preferable in terms of insulation can be attained. In accordance with the second embodiment, when chucking the tape T with the upper chucking member 11*a* and the lower chucking member 11*b*, the tape T is deformed downwards in the convex shape as indicated by the dotted line. It becomes therefore easy to align the center of the tape T with the center of the bobbin B, whereby the proper winding can be conducted.

FIGS. 9 to 21 are side views each showing a taping device 30 in a third embodiment of the present invention.

Figure 9:
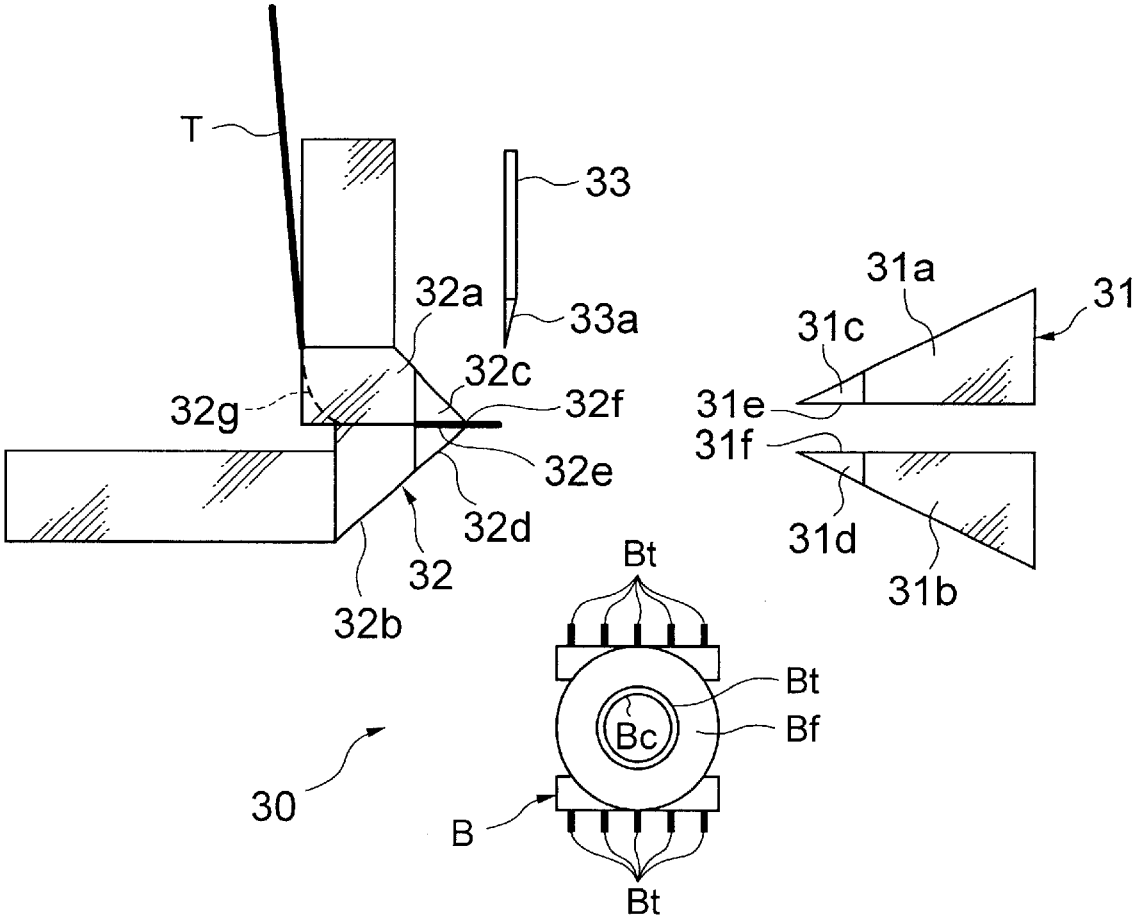
FIG. 9 is a side view showing the taping device in a third embodiment of the present invention.

Referring to FIG. 9, the taping device 30 includes a leading chuck 31 constructed of a pair of arms 31*a*, 31*b*, and a supply unit (grasping means) 32 including a pair of arms 32*a*, 32*b*, and a cutter 33.

The bobbin B wound with the wire member in five tiers (the number of tiers is not necessarily limited to five), has the cylindrical member Bc serving as the bottom surface member having the width of, e.g., 2 mm or smaller, and flange members Bf formed at both ends thereof and extending in the radial directions. Note that the terminal pins Bt to which ends of the wire members (not shown) wound thereon are secured, are formed along the outer periphery of the one-sided flange member Bf. The bobbin B is rotatable by an unillustrated drive unit and may also be movable in at least two-dimensional directions.

The leading chuck 31 is capable of moving the pair of arms 31*a*, 31*b* apart from or close to each other, and is movable in the three-dimensional directions including at least the two-dimensional directions in FIG. 9. A drive unit for the leading chuck 31 is not shown herein.

The arms 31*a*, 31*b* of the leading chuck 31 are, as shown on the left side in FIG. 9, provided with chucking members 31*c*, 31*d* having a width narrower than the cylindrical member Bc of the bobbin B. Chucking surfaces 31*e*, 31*f* facing to each other are provided at left ends of the chucking members 31*c*, 31*d*.

The supply member 32 supplied with the tape T has a pair of arms 32*a*, 32*b*, and is also capable of moving the pair of arms 32*a*, 32*b* apart from or close to each other by driving at least the lower arm 32*b*. A drive unit for the supply member 32 is not shown either.

The arms 32*a*, 32*b* of the supply member 32 (serving as the grasping means) are, as shown on the right side in FIG.9, provided with chucking members 32*c*, 32*d* having a width narrower than the cylindrical member Bc of the bobbin B. Chucking surfaces 32*e*, 32*f* facing to each other are provided at right ends thereof. A cutter edge 33*a* of the cutter 33 has a width narrower than at least a space between the flange members Bf of the bobbin B, and is movable in at least up-and-down directions. An explanation of a drive unit for the cutter 3 is also omitted herein.

Next, an operation of the third embodiment will be described. To begin with, it shall be assumed that the first-tiered winding W has already been wound on the bobbin B, and the arms 32*a*, 32*b* of the supply member 32 hold the tape in a state where the same arms remain closed. The leading chuck 31 is moved from the state shown in FIG. 9 toward the supply member 32 by the unillustrated drive unit in order to grasp a leading end of the tape T that is exposed from a supply path 32*g* of the supply member 32. Note that the width of the tape T is set slightly larger than the width of the cylindrical member Bc of the bobbin B, and the under surface of the tape T is formed as an adhesive surface.

Figure 10:
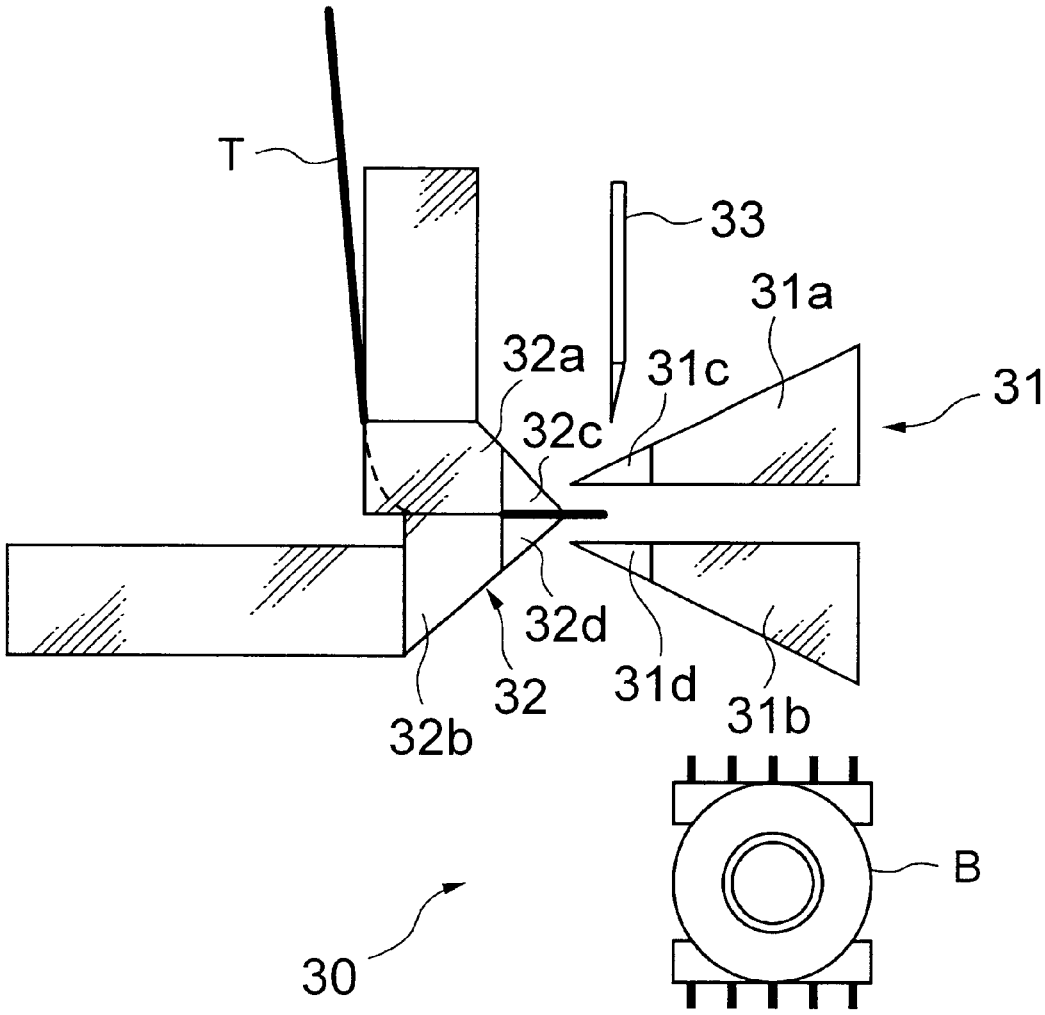
FIG. 10 is a side view showing the taping device in the third embodiment of the present invention.
Figure 11:
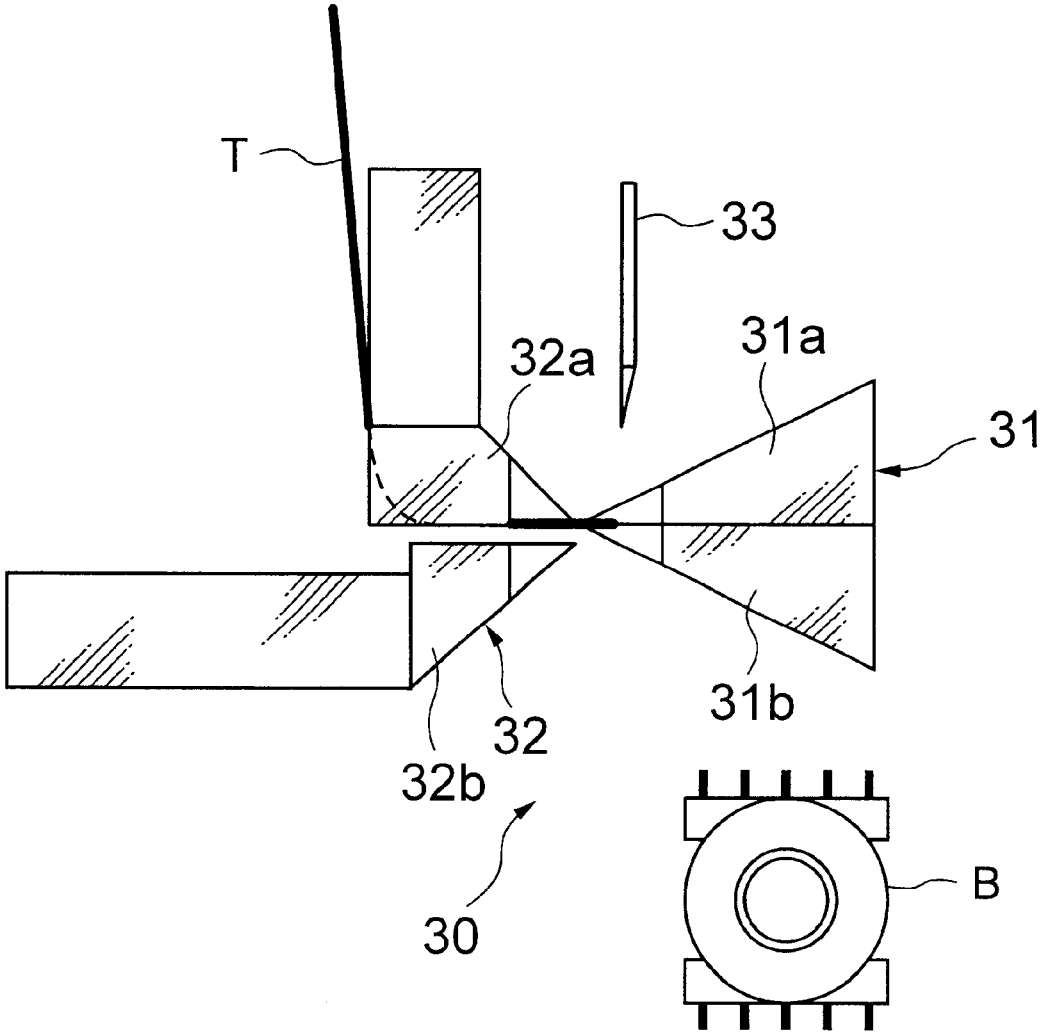
FIG. 11 is a side view showing the taping device in the third embodiment of the present invention.

Subsequently, as shown in FIG. 10, the arms 31*a*, 31*b* of the leading chuck 31 are stopped just when arriving at such a position that the leading end of the tape T extruding from the supply path 32*g* of the supply member 32 enters an aperture between the arms 31*a*, 31*b* enough to be bitten as seen in the vertical direction. Then, the arms 31*a*, 31*b* are made close to each other, and the leading end of the tape T is bitten by the chucking surfaces 31*e*, 31*f* of the chucking members 31*c*, 31*d*. Thereafter, as shown in FIG. 11, the tape T is released by opening the arms 32*a*, 32*b* of the supply member 32.

Figure 12:
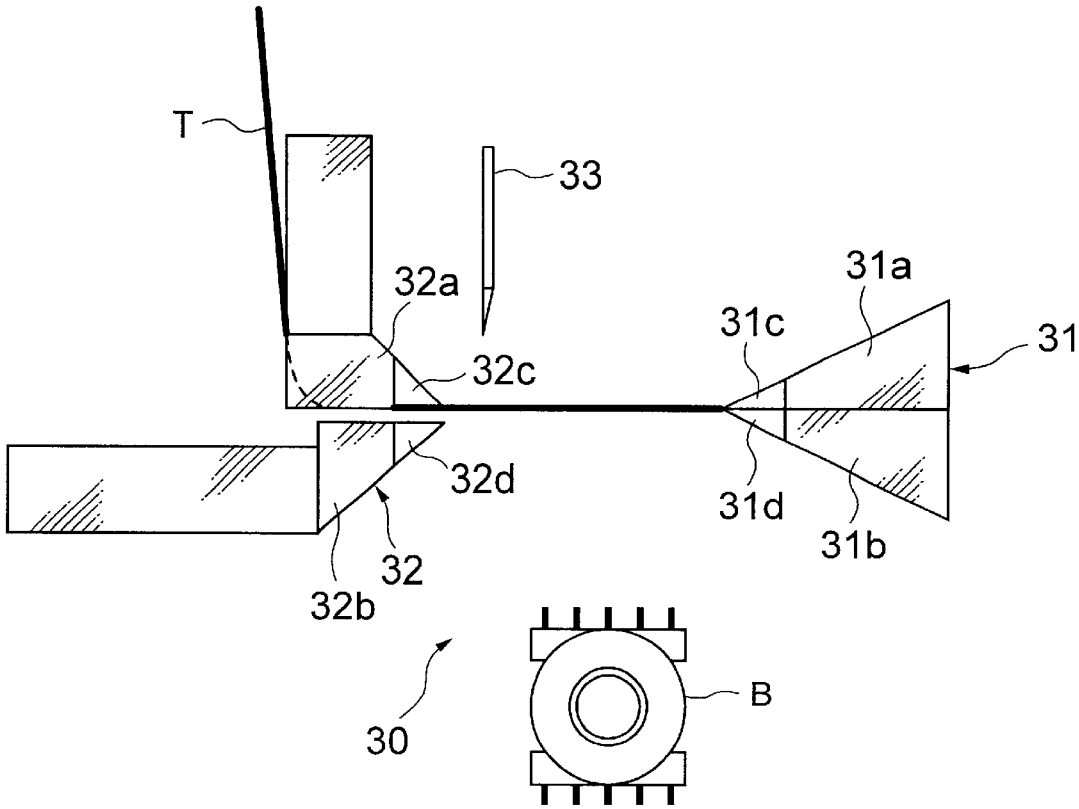
FIG. 12 is a side view showing the taping device in the third embodiment of the present invention.
Figure 13:
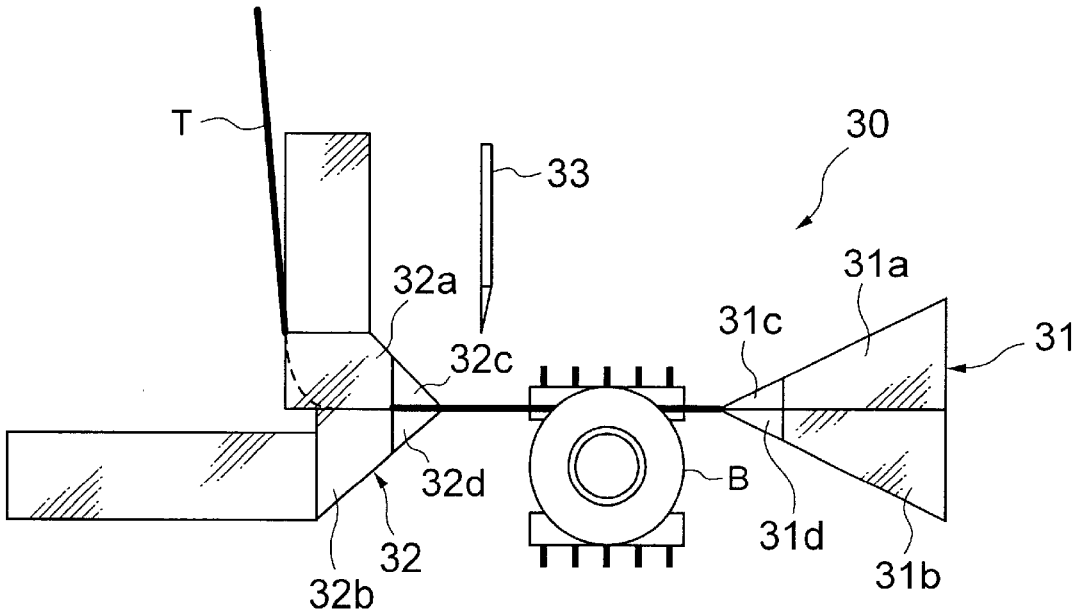
FIG. 13 is a side view showing the taping device in the third embodiment of the present invention.

Further, as shown in FIG. 12, the leading chuck 31 is moved rightward upwardly of the bobbin B in order to pull out the tape T by a length enough to be wound in such a way that the leading end of the tape T is kept bitten. Note that the tape T is pulled out by the length enough to be adhered to the bobbin B, then the leading end or its vicinity of the tape T is adhered thereto, the tape T is thereafter further pulled out by rotating the bobbin B, and a winding quantity may thereby be adjusted. This point will hereinafter be described. Thereafter, as shown in FIG. 13, after the tape T has been grasped by closing the arms 32*a*, 2*b* of the supply member 32, the leading chuck 31 and the supply member 32 are moved downward (or the bobbin B may be raised).

Figure 14:
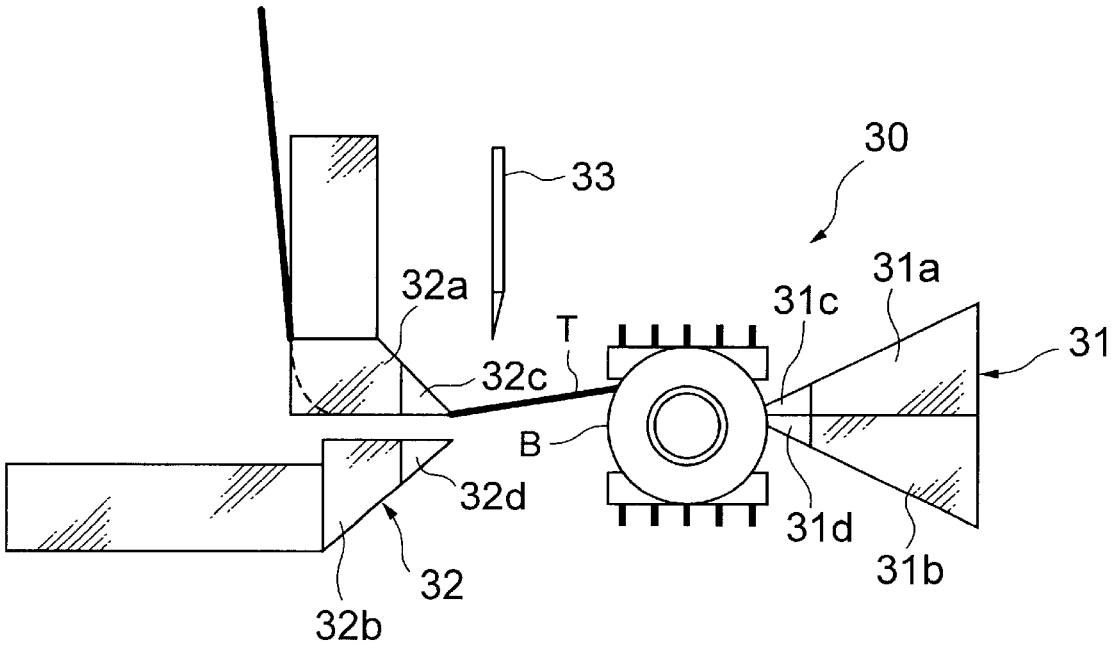
FIG. 14 is a side view showing the taping device in the third embodiment of the present invention.
Figure 15:
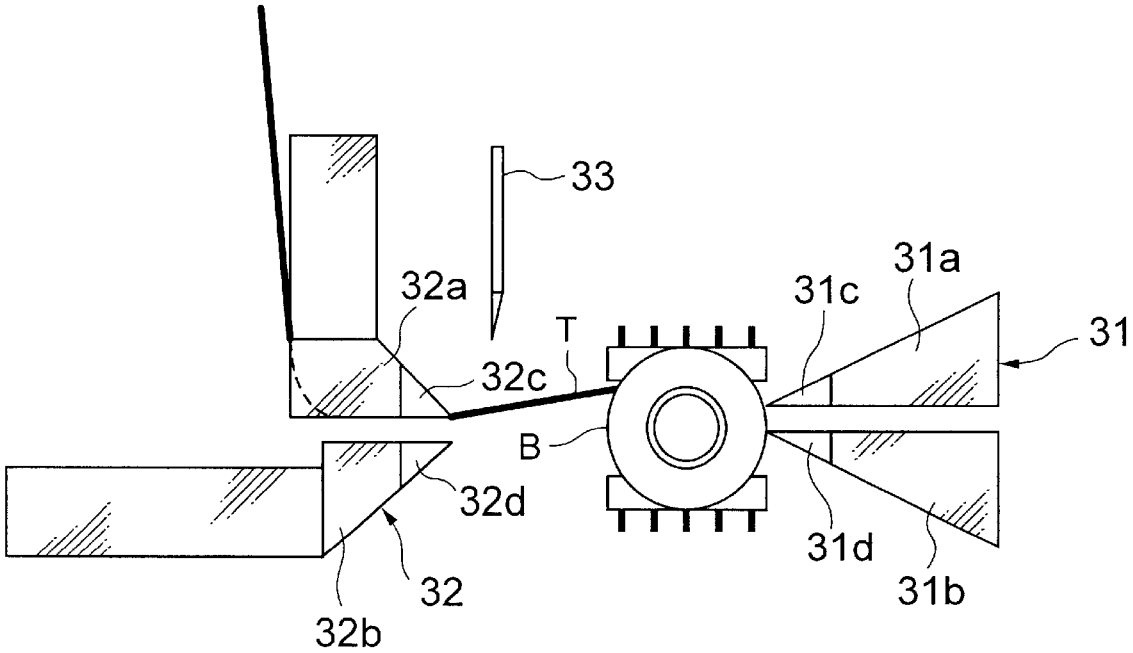
FIG. 15 is a side view showing the taping device in the third embodiment of the present invention.

Furthermore, as illustrated in FIG. 14, the tape T is released by opening the arms 32*a*, 32*b* of the supply member 32, and the chucking members 31*c*, 31*d* of the leading chuck 31 are moved to enter between the flange members Bf of the bobbin B. In this state, the tape adhesive surface in the vicinity of the leading end of the tape T is adhered to the periphery of the first-tiered winding, and the arms 31*a*, 31*b* are set apart from each other in this as-adhered state (see FIG. 15), with the result that the leading end vicinity Ta of the tape T is adhered to the surface of the wire member W wound on the bobbin B. Accordingly, though there is a small peeled-off area of the tape T on its leading end side, the leading chuck 1 may be driven so that the arm 31*a* or 31*b* touches the peeled-off area of the tape T down along the periphery of the winding.

Figure 16:
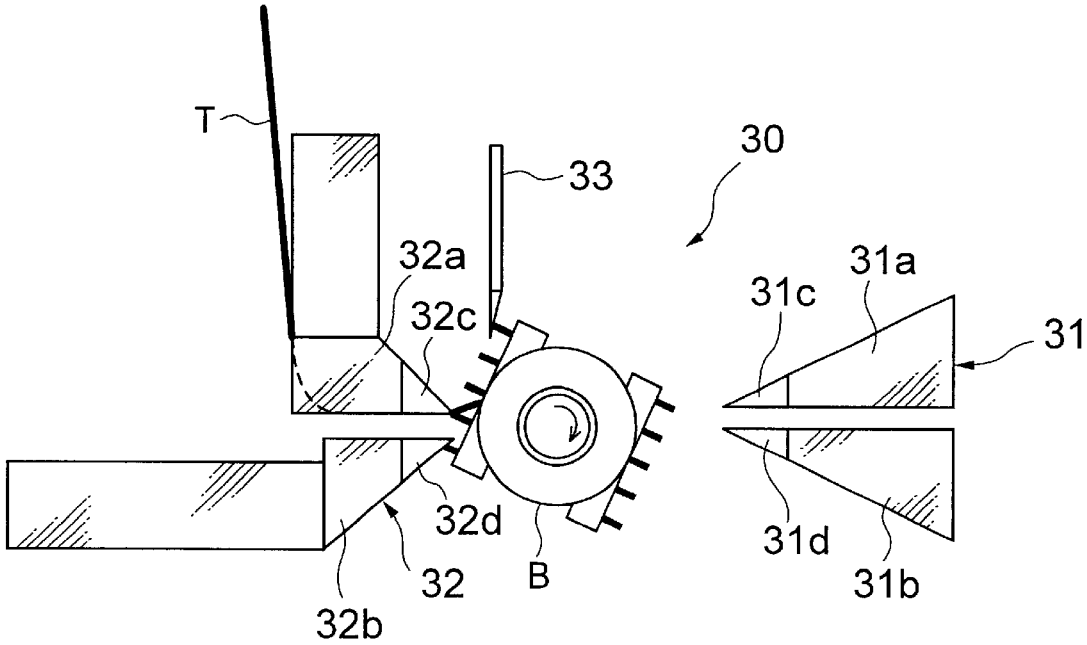
FIG. 16 is a side view showing the taping device in the third embodiment of the present invention.
Figure 17:
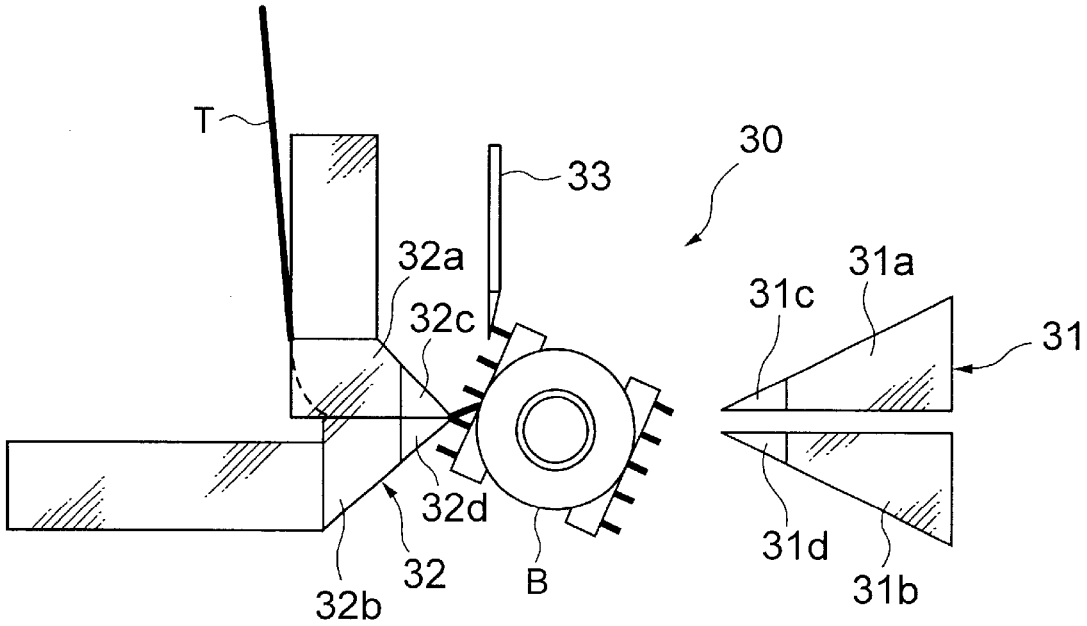
FIG. 17 is a side view showing the taping device in the third embodiment of the present invention.
Figure 18:
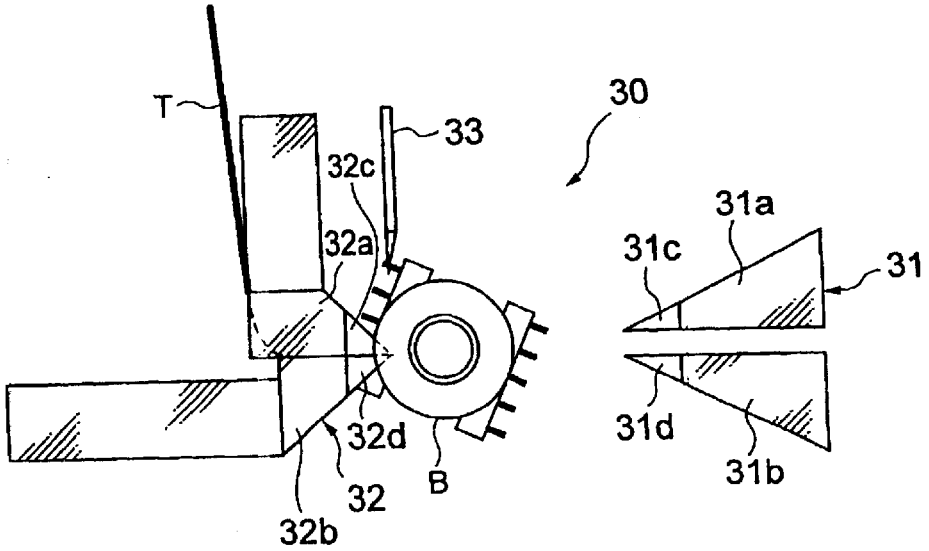
FIG. 18 is a side view showing the taping device in the third embodiment of the present invention.

Thereafter, as shown in FIG. 16, the bobbin B is rotated with a predetermined number of rotations, and the supply member 32 is moved towards the bobbin B (a winding quantity may also be minutely adjusted in such a manner that the tape T is pulled out fast by causing high rotations of the bobbin B in the state where the supply member 32 is stopped or while moving the supply member 32 at a slow velocity). Then, when the supply member 32 and the bobbin B get close to each other, as shown in FIG. 17, the arms 32*a*, 32*b* of the supply member 32 are made proximal to each other enough to bite the tale T. Further, as shown in FIG. 18, the arms 32*a*, 32*b* are made to enter between the flange members Bf of the bobbin B. At this time, the arms 32*a*, 32*b* are once brought into contact with the bottom surface member Bc (FIG. 9) of the bobbin B and, it is preferable, be moved back slightly. In such a state, the arms 32*a*, 32*b* become close proximity to the surface of the winding wound on the bobbin B.

Figure 19:
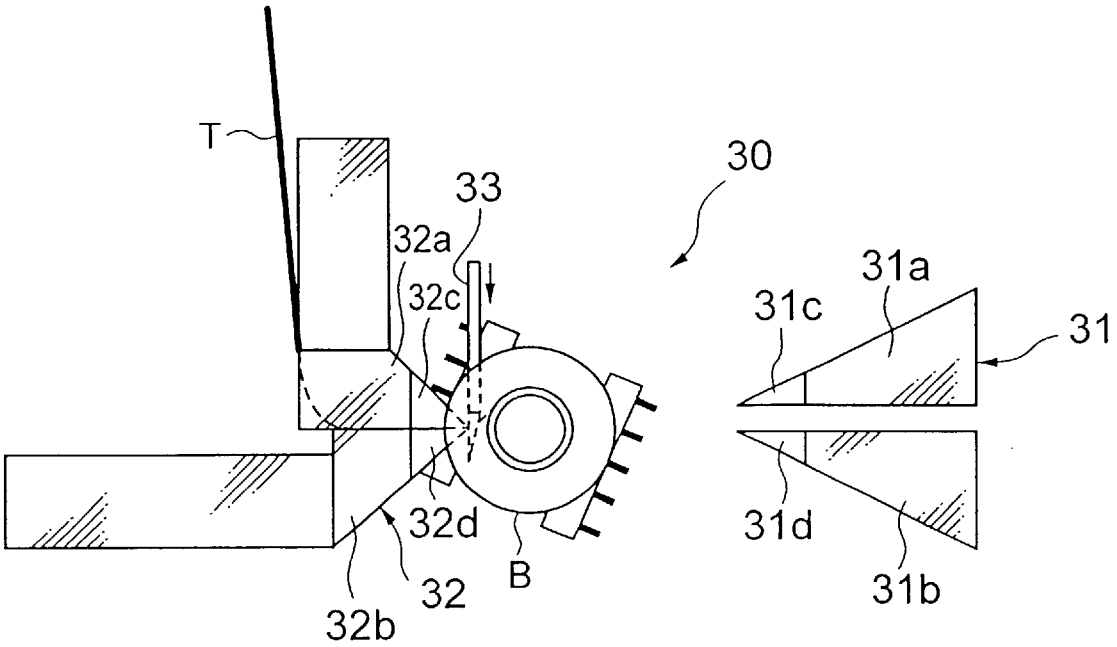
FIG. 19 is a side view showing the taping device in the third embodiment of the present invention.

Subsequently, as illustrated in FIG. 19, at least the cutter edge 33*a* is moved to enter between the flange members Bf of the bobbin B by lowering the cutter 33, and the tape T is cut off between the arms 32*a*, 32*b* and the surface of the winding wound on the bobbin B. The arms 32*a*, 32*b* are in close proximity to the surface of the winding wound on the bobbin B, and hence there is a small peeled-off area at the trailing end of the tape T. The supply member 32 may, however, be driven so that the cutter 33 (or the arm 32*a* or 32*b*) touches the peeled-off area of the tape T down along the periphery of the winding. Note that after cutting the tape T, the tape T is kept in a state of slightly extruding from the supply member 32 (see FIG. 21). With this contrivance, the leading chuck 31 becomes easy to chuck the leading end of the tape T in the next process.

Figure 20:
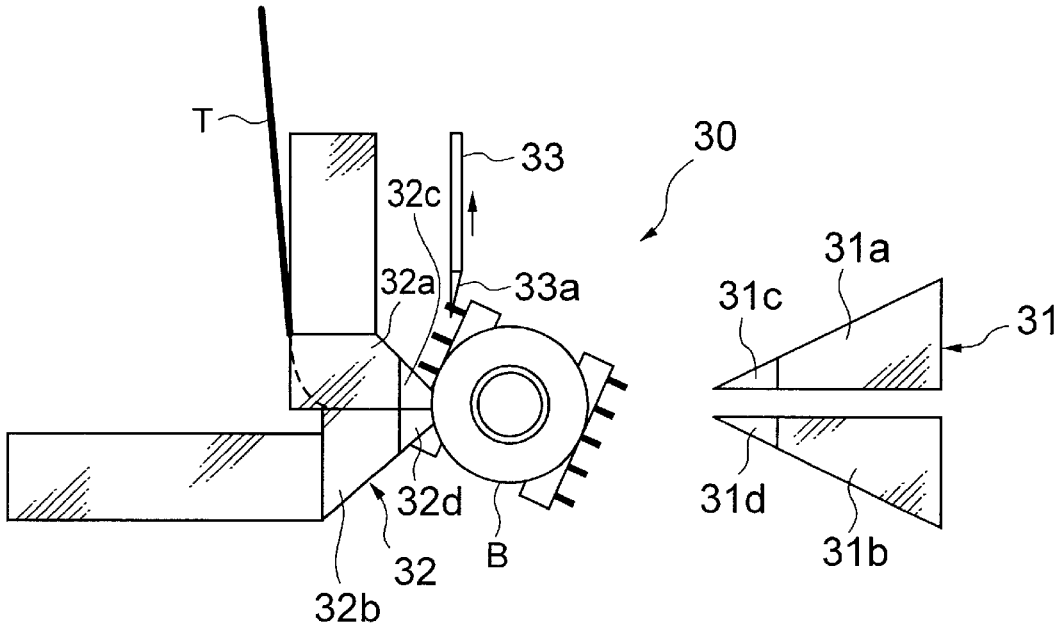
FIG. 20 is a side view showing the taping device in the third embodiment of the present invention.
Figure 21:
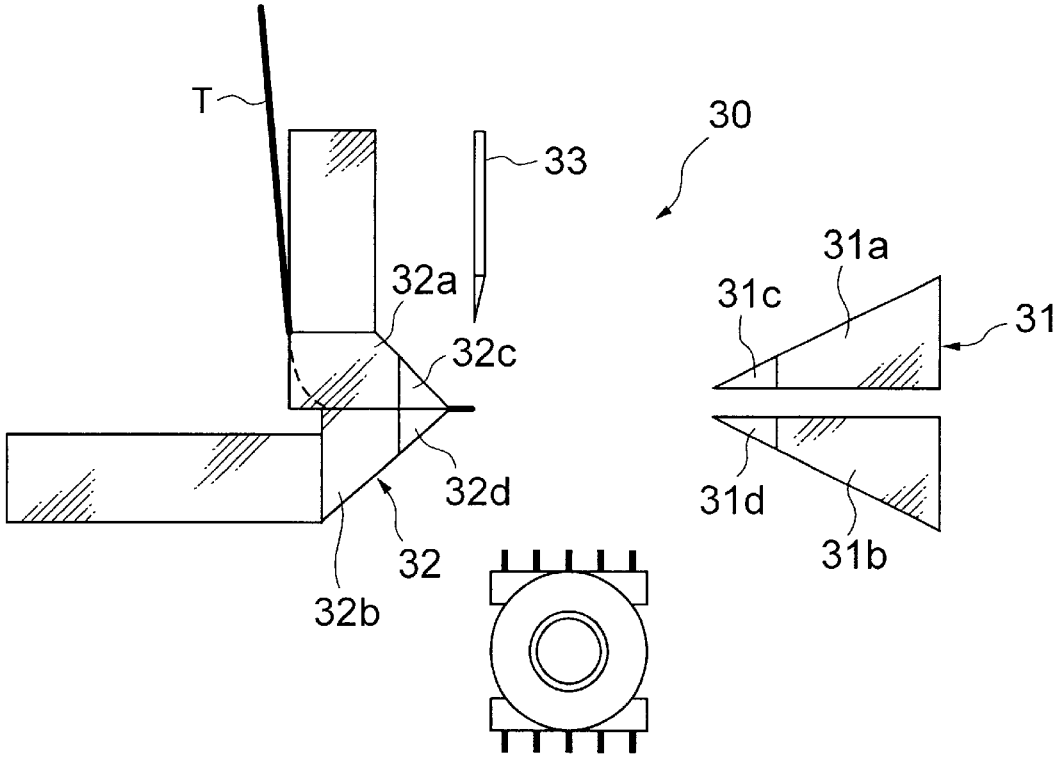
FIG. 21 is a side view showing the taping device in the third embodiment of the present invention.

Thereafter, as shown in FIG. 20, the cutter 33 is moved away upwards, and the leading chuck 31 and the supply member 32 are moved upwards as shown in FIG. 21 (or the bobbin B is lowered), thereby finishing the tape winding process. Then, the winding of a next tier may be carried out.

As discussed above, according to the third embodiment, the arms 32*a*, 32*b* of the supply member 32 and the cutter 33 have the small widths, and are therefore capable of entering between the flange members Bf of the bobbin B. Accordingly, when cutting the tape T, only the slight-length tape segment T is not adhered to the surface of the wire member W wound on the cylindrical member Bc of the bobbin B, whereby a disordered state at the trailing end of the tape can be restrained as much as possible and an ill-wound state of the tape can be also restrained.

The present invention has been discussed so far by way of the embodiments. The present invention should not be, however, interpreted in a mode of being limited to the above embodiments, and may, as a matter of course, properly varied and modified. For example, the configuration of the chuck may not be the circular arc as viewed from the front, and may be a V-shape. Further, the cylindrical member serving as the bottom surface member of the bobbin may also take configurations such as an elliptical column and an angular column. Moreover, the cutter edge may be formed not integrally with but separately from the trailing chuck.

The taping device according to a first invention winds the tape on the bottom surface member or on the winding wound on the bottom surface member of the bobbin including the bottom surface member wound with the wire member and the pair of flange members extending in the radial directions from the bottom surface member. This taping device includes the trailing chuck provided with the chucking members entering between the flange members of the bobbin while grasping the trailing end or its vicinity of the tape wound on the bobbin. The chucking members are therefore capable of approaching the bottom surface member (including the state of being wound with the wire member) while grasping the trailing end or its vicinity of the tape, whereby the disordered state at the trailing end of the tape can be restrained to the greatest possible degree and the ill-wound state of the tape can be therefore restrained.

The taping device according to a second invention has the bobbin including the bottom surface member wound with the wire member and the pair of flange members extending in the radial directions from this bottom surface member, and the tape is wound on the bottom surface member. In this taping device, the chucking members of the chuck for grasping the tape has such a configuration that at least a part of the surface, closer to the bottom surface member of the bobbin, of the tape becomes convex when grasping the tape. Hence, the convex area is matched with a corresponding portion of the bottom surface member (including the state of being wound with the wire member), whereby the winding can be performed with a high accuracy by aligning the central position of the bottom surface member with the central line of the tape.

A taping method, according to a third invention, of winding the tape on the bottom surface member of the bobbin including the bottom surface member wound with the wire member and the pair of flange members extending in the radial directions from this bottom surface member, includes a step of pulling the tape out of the supply member for the tape in such a way that the chucking members of the leading chuck grasp the leading end or its vicinity of the tape, a step of making the chucking members of the leading chuck enter between the flange members of the bobbin, adhering the leading end or its vicinity of the tape to the bottom surface member, and thereafter releasing the tape from the chucking members of the leading chuck, a step of cutting off the tape with the chucking members of the trailing chuck while grasping the tape in a position spaced at a predetermined distance away from the leading end thereof as well as being closer to the supply member than the grasping position, a step of making the trailing chuck proximal to the bobbin together with the tape of which the trailing end or the vicinity is grasped by the chucking members in synchronization with the rotations of the bobbin, and a step of releasing the tape after adhering the tape to the bottom surface memberby making the chucking members of the trailing chuck enter between the flange members of the bobbin. The chucking members are therefore capable of approaching the bottom surface member (including the state of being wound with the wire member) while grasping the leading and trailing ends or their vicinities of the tape, whereby the disordered states at the leading and trailing ends of the tape can be restrained to the greatest possible degree and the ill-wound state of the tape can be therefore restrained.

A taping method, according to a fourth invention, of winding the tape on the bottom surface member of the bobbin including the bottom surface member wound with the wire member and the pair of flange members extending in the radial directions from this bottom surface member, includes a step of pulling the tape out of the supply member for the tape in such a way that the chucking members of the leading chuck grasp the leading end or its vicinity of the tape, a step of making the chucking members enter between the flange members of the bobbin, adhering the leading end or its vicinity of the tape to the bottom surface member, and thereafter releasing the tape from the chucking members of the leading chuck, a step of making the bobbin and the supply member for the tape approach each other with the tape wound on the bottom surface member of the bobbin by rotating the bobbin with a predetermined number of rotations, a step of making at least a part of the supply member for the tape enter between the pair of flange members of the bobbin by pressing the tape against the supply member for the tape, and a step of cutting off the tape with the cutter edge having a width narrower than a space between the flange members of the bobbin between the supply member for the tape and the bottom surface member of the bobbin. Hence, in addition to the effects of the inventions described above, when cutting off the tape, there is a small area in the vicinity of the trailing end of the tape that is separated from the bottom surface member (including the state of being wound with the wire member), whereby the disordered states at the leading of the tape as well as at trailing end can be restrained as much as possible and the ill-wound state of the tape can be therefore restrained.

What is claimed is:

1. A taping device for winding a tape on a bottom surface member or on a winding wound on said bottom surface member of a bobbin which including said bottom surface member wound with a wire member and a pair of flange members extending in radial directions from said bottom surface member, said taping device comprising:

grasping means provided with a grasping unit entering between said flange members of said bobbin while grasping a trailing end or its vicinity of the tape wound on said bobbin.

2. A taping device according to claim 1, wherein said grasping means is a trailing chuck.

3. A taping device according to claim 2, wherein said grasping member of said trailing chuck has a width equal to or smaller than a width of the tape.

4. A taping device according to claim 2, wherein said trailing chuck has a cutter edge for cutting off the tape.

5. A taping device according to claim 2, wherein said supply member for the tape is provided with said grasping means.

6. A taping device for winding a tape on a bottom surface member of a bobbin which including said bottom surface member wound with a wire member and a pair of flange members extending in radial directions from said bottom surface member, said taping device comprising:

a chuck for grasping the tape, wherein grasping members of said chuck have such a configuration that at least part of the surface, closer to said bottom surface member of said bobbin, of the tape becomes convex when grasping the tape.

7. A taping method of winding a tape on a bottom surface member of a bobbin which including the bottom surface member wound with a wire member and a pair of flange members extending in radial directions from said bottom surface member, comprising:

a step of pulling the tape out of a supply unit for the tape in such a way that chucking members of a leading chuck grasp a leading end or its vicinity of the tape;

a step of making said chucking members of said leading chuck enter between the flange members of the bobbin, adhering the leading end or its vicinity of the tape to the bottom surface member, and thereafter releasing the tape from the chucking members of the leading chuck;

a step of cutting off the tape with chucking members of a trailing chuck while grasping the tape in a position spaced at a predetermined distance away from the leading end thereof and on the side closer to the supply unit than the grasping position;

a step of making said trailing chuck proximal to said bobbin together with the tape of which the trailing end or the vicinity is grasped by said chucking members in synchronization with rotations of said bobbin; and a step of releasing the tape after adhering the tape to said bottom surface member by making said chucking members of said trailing chuck enter between said flange members of said bobbin.

8. A taping method according to claim 7, wherein said trailing chuck moves toward said bobbin while giving a predetermined tension to the grasped tape.

9. A taping method of winding a tape on a bottom surface member of a bobbin which including the bottom surface member wound with a wire member and a pair of flange members extending in radial directions from said bottom surface member, comprising:

a step of pulling the tape out of a supply unit for the tape in such a way that chucking members of a leading chuck grasp a leading end or its vicinity of the tape;

a step of making said chucking members of said leading chuck enter between the flange members of the bobbin, adhering the leading end or its vicinity of the tape to the bottom surface member, and thereafter releasing the tape from the chucking members of the leading chuck;

a step of making said bobbin and said supply unit for the tape approach each other with the tape wound on said bottom surface member of said bobbin by rotating said bobbin with a predetermined number of rotations;

a step of making at least a part of the supply unit for the tape enter between said pair of flange members of said bobbin by pressing the tape against said supply unit for the tape; and a step of cutting off the tape with a cutter edge having a width narrower than a space between said flange members of said bobbin, between said supply unit for the tape and said bottom surface member of said bobbin.

10. A taping method according to claim 9, further comprising a step of pulling the tape out of said supply unit for the tape by rotating said bobbin.

* * * * *